US008827261B2

(12) United States Patent
Hoiruchi

(10) Patent No.: US 8,827,261 B2
(45) Date of Patent: Sep. 9, 2014

(54) SHEET-HANDLING APPARATUS

(71) Applicant: Kabushiki Kaisha Toshiba, Tokyo (JP)

(72) Inventor: Haruhiko Hoiruchi, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/785,974

(22) Filed: Mar. 5, 2013

(65) Prior Publication Data

US 2013/0241135 A1 Sep. 19, 2013

(30) Foreign Application Priority Data

Mar. 16, 2012 (JP) ..... P2012-060043

(51) Int. Cl.

| | |
|---|---|
| ***B65H 3/34*** | (2006.01) |
| ***B65H 3/46*** | (2006.01) |
| ***B65H 3/52*** | (2006.01) |
| ***B65H 3/08*** | (2006.01) |

(52) U.S. Cl.

USPC ..... 271/104; 271/106; 271/90; 271/121

(58) Field of Classification Search

USPC ..... 271/90, 104, 107, 108, 42, 11, 121, 271/103, 94, 95

See application file for complete search history.

(56) References Cited

U.S. PATENT DOCUMENTS

| | | | | |
|---|---|---|---|---|
| 3,260,520 | A * | 7/1966 | Sugden | 271/94 |
| 5,029,839 | A * | 7/1991 | Kajiwara et al. | 271/121 |
| 5,290,022 | A * | 3/1994 | Sabatier et al. | 271/12 |
| 5,391,051 | A * | 2/1995 | Sabatier et al. | 414/797.2 |
| 5,823,524 | A * | 10/1998 | Kawada | 271/124 |
| 6,270,069 | B1 * | 8/2001 | Cera et al. | 271/104 |
| 7,168,700 | B2 * | 1/2007 | Skadow et al. | 271/270 |

FOREIGN PATENT DOCUMENTS

| | | |
|---|---|---|
| JP | P200787861 | 4/2007 |
| JP | P200863110 | 3/2008 |
| JP | P200951657 | 3/2009 |

* cited by examiner

*Primary Examiner* — Patrick Cicchino
(74) *Attorney, Agent, or Firm* — Baker Botts L.L.P.

(57) ABSTRACT

A sheet-handling apparatus is disclosed that reliably separates sheet-like articles and prevents double take-outs, regardless of the thickness of the sheet-like articles that are taken out. The sheet-handling apparatus includes a take-out portion to take out sheet-like articles; a feeding portion to feed the sheet-like articles that have been taken out by the take-out portion; and a separation portion facing the feeding portion across a gap, the separation portion being adapted to separate sheet-like articles that have been taken out by the take-out portion in an overlapping state into individual sheet-like articles; wherein the separation portion is adapted to elastically deform depending on a thickness of the sheet-like articles and vary the size of the gap.

17 Claims, 4 Drawing Sheets

SHEET-HANDLING APPARATUS

CROSS-REFERENCE TO RELATED APPLICATION(S)

This application is based upon and claims the benefit of priority from Japan Patent Application(s) No. P2012-060043, filed on Mar. 16, 2012, the entire contents of which are incorporated herein by reference.

FIELD

Embodiments of the present disclosure relate to a sheet-handling apparatus.

BACKGROUND

In recent years, there is the tendency for sheet-handling apparatuses that the letter (sheet-like article) size that can be handled according to the requirements of mail-handling machines increases, and also the requirements for thickness are increasing year by year from 6 mm, 8 mm to 10 mm and beyond.

Mail-handling machines are equipped with a take-out belt for taking out sheet-like articles, and the sheet-like articles taken out by this take-out belt are separated into individual items by a separation mechanism (mechanism for preventing double take-outs) and then fed downstream.

The separation mechanism may include a vacuum chucking backward-feeding roller that is arranged with a certain gap to the take-out belt, and sheet-like articles are pushed back by being sucked to this backward-feeding roller. The backward-feeding roller is rotatingly driven by a driving mechanism, so that it is arranged at a fixed position.

However, conventionally, the backward-feeding roller is made of a hard material, and the gap between the backward-feeding roller and the take-out belt has a constant size, so that that there is a limit to the thickness of the processed letters that can pass the gap between the take-out belt and the backward-feeding roller.

For this reason, sheet-like articles that are thicker than the gap between the take-out belt and the backward-feeding roller cannot pass the gap and thus cannot be taken out. Moreover, if the gap between the take-out belt and the backward-feeding roller is enlarged, then the problem may arise that the distance too the backward-feeding roller may become too large for thin sheet-like articles, and the functionality of preventing double take-outs may be lost.

While it is conceivable to move the backward-feeding roller and adjust the size of the gap between the backward-feeding roller and the take-out belt in accordance with the thickness of the sheet-like article, in this case, there is the problem that the time needed for this movement is too long as the mass of the backward-feeding roller is quite large, so that the adjustment of the size of the gap cannot be accomplished in time.

Patent Document JP 2007-326713A is an example of related art.

SUMMARY OF THE DISCLOSURE

It is an object of the present disclosure to provide a sheet-handling apparatus that can reliably separate sheet-like articles and prevent double take-outs, regardless of the thickness of the sheet-like articles that are taken out.

To achieve this object, in one embodiment, a sheet-handling apparatus includes a take-out portion to take out sheet-like articles; a feeding portion to feed the sheet-like articles that have been taken out by the take-out portion; and a separation portion facing the feeding portion across a gap, the separation portion being adapted to separate sheet-like articles that have been taken out by the take-out portion in an overlapping state into individual sheet-like articles; wherein the separation portion is adapted to elastically deform depending on a thickness of the sheet-like articles and vary the size of the gap.

DETAILED DESCRIPTION

The following is an explanation of embodiments of the disclosure with reference to the accompanying drawings.

Figure 1:
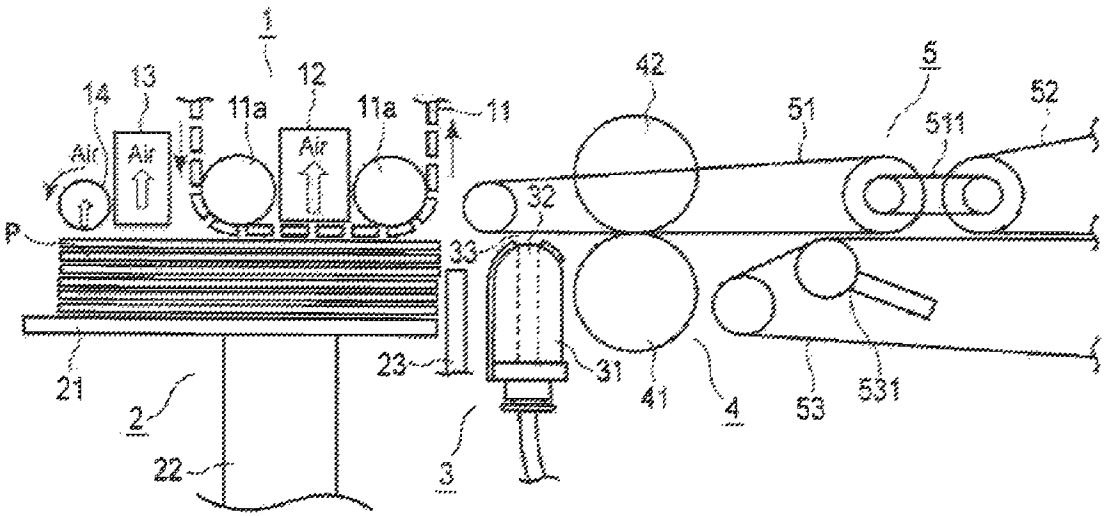
FIG. 1 is a structural diagram showing an apparatus for taking out sheet-like articles according to one embodiment.

FIG. 1 is a structural diagram showing a sheet-handling apparatus such as a mail-handling machine, according to one embodiment.

This sheet-handling apparatus includes a take-out portion 1 serving as a take-out portion for taking out sheet-like articles P, such as letters, a supply portion 2 that supplies the sheet-like articles P to the take-out portion 1, and a separation portion 3 that separates the sheet-like articles P taken out from the take-out portion 1 into individual sheet-like articles. Moreover, it includes a gap correction portion 4 that feeds the sheet-like articles P separated by the separation portion 3 with a predetermined gap, and a conveying portion 5 that conveys the sheet-like articles P fed from the gap correction portion 4. The sheet-like articles that are taken out may have a variety of thicknesses.

The take-out portion 1 includes a take-out belt 11, which may be a suction belt with holes. The take-out belt 11 is spanned over rollers 11*a* and is rotatingly driven at a constant speed by a driving portion not shown in the drawings. An air chamber 12 is provided on the inward side of the take-out belt 11, and a positive/negative pressure generating device (vacuum pump) that is not shown in the drawings is connected to this air chamber 12 via a valve. At negative pressure, the air chamber 12 sucks the sheet-like article P to the take-out belt 11, and at positive pressure, it does not suck the sheet-like article P to the take-out belt 11.

A sub-chamber 13 is arranged on upstream side of the take-out belt 11, and is connected to a negative pressure generating portion that is not shown in the drawings (e.g. the drawing side of a blower). The sub-chamber 13 draws sheet-like articles P located at a distant position to the take-out portion 1, and prevents double take-outs by suctioning the second sheet-like article P in a stationary manner after the rear end of the first sheet-like article P has passed the sub-chamber 13.

An assist roller 14 is arranged on the upstream side of the sub-chamber 13. The assist roller 14 is provided with suction holes and is arranged to draw in air only from the side that faces the sheet-like articles P. The assist roller 14 serves the function of suctioning the sheet-like articles P and feeding them downstream.

The supply portion 2 is provided with a backup paddle 21 that supports the sheet-like articles P, and the sheet-like articles P are placed in an upright posture along a guide wall 23 on a supply belt 22 on the floor. The supply portion 2 is provided with a detection portion (not shown in the drawings) for detecting the presence of a sheet-like article P near the take-out portion 1. The supply portion 2 supplies the sheet-like articles P by moving the backup paddle 21 and the supply belt 22 towards the take-out portion 1 when the detection portion (not shown in the drawings) has detected that there is no sheet-like article P near the take-out portion 1.

The separation portion 3 is provided with a double take-out prevention block 31 serving as a separation portion. This double take-out prevention block 31 is arranged such that it faces a conveying belt 51 serving as a feeding portion, which is explained further below, across a gap 33.

The double take-out prevention block 31 is provided with suction holes 32, and these suction holes 32 are connected to a negative pressure generating device (vacuum pump), which is explained further below. If two sheet-like articles are taken out by the take-out belt 11 at the same time, then the double take-out prevention block 31 suctions the sheet-like article on the side of the double take-out prevention block 31 and stops it, so that the two sheet-like articles are not fed at the same time to the gap correction portion 4.

The above-noted gap correction portion 4 is constituted by a sponge roller 41 and a drive roller 42. The sponge roller 41 is an elastic roller that can be deformed in accordance with the thickness of the sheet-like article P. The drive roller 42 is directly driven by an AC servo motor not shown in the drawings.

The sheet-like article P is sandwiched between the sponge roller 41 and the drive roller 42, and its conveying speed changes in accordance with the driver roller 42 being accelerated or decelerated due to a command from a controller not shown in the drawings. Thus, the interval (gap) to the preceding sheet-like article P can be adjusted. That is to say, if the interval (gap) to the preceding sheet-like article P is smaller than a certain specified value, then the sheet-like article P is slowed down and the interval (gap) is widened, and if the interval (gap) to the preceding sheet-like article P is larger than a certain specified value, then the sheet-like article P is sped up and the interval (gap) is reduced.

The conveying portion 5 is constituted by conveying belts 51, 52 and 53. The conveying belt 52 is rotated by a driving source not shown in the drawings, and the conveying belt 51 serving as a feeding portion is rotated by the motive force of the conveying belt 52 through a relay belt 511. The conveying belt 53 is rotated by a driving source not shown in the drawings.

The conveying belt 53 is pushed up by a spring tension roller 531 and is in contact with the conveying belt 51. When a sheet-like article P with large thickness is conveyed to it, the spring tension roller 531 is pushed downward, so that the sheet-like article P can pass.

Figure 2:
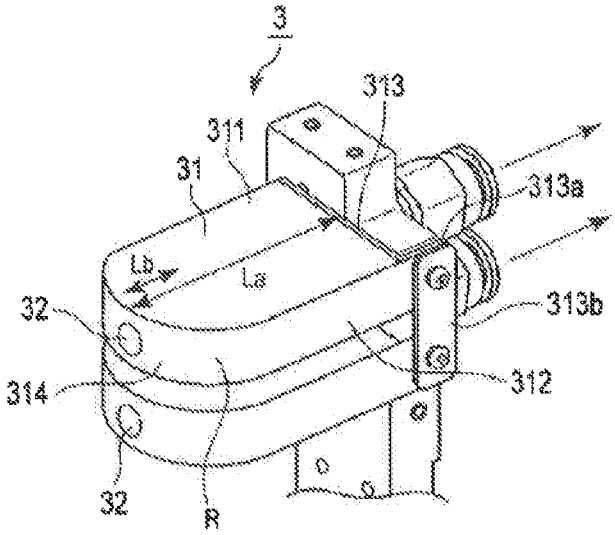
FIG. 2 is a perspective view showing the double take-out prevention block of FIG. 1.
Figure 3:
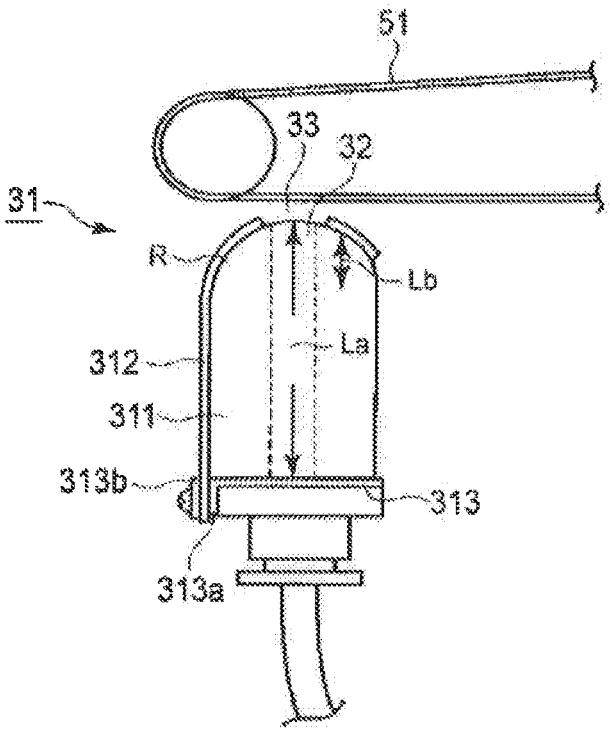
FIG. 3 is a diagram illustrating the gap between the double take-out prevention block of FIG. 2 and the conveying belt.

FIG. 2 is a perspective view showing the above-mentioned double take-out prevention block 31. FIG. 3 is a top view thereof.

The double take-out prevention block 31 includes a porous portion 311 that is made of a porous material serving as an elastic member, and this porous portion 311 is provided with the suction holes 32. By making it out of a porous material, it is deformable in accordance with the thickness of the sheet-like article P, it can be made very light, and moreover the porous material itself has resilience, so that the time after deformation until it returns to its original shape can be shortened.

The base-end side of the porous portion 311 is adhered to a support member 313, and its front-end side has a circular arc-shaped surface 314. The suction holes 32 are formed in this circular arc-shaped surface 314, and arranged such that the suction holes 32 and the sheet-like article P do not adhere completely together. It should be noted that if the suction holes were formed in a flat surface, there would be the risk that the suction holes and the sheet-like article P would adhere closely together and might not detach.

A surface material 312 is bonded to the circular arc-shaped surface 314 and a portion of the porous portion 311 on the side where the sheet-like article is introduced, but not at the suction holes 32, increasing the abrasion resistance with respect to sheet-like articles P that collide and come into contact therewith. As the surface material 312, it is possible to use a stainless steel member of for example 0.1 mm thickness, influencing the elastic deformation of the porous portion 311 as little as possible and keeping the weight as low as possible.

A folded portion 313*a* is formed on one end of the support member 313 and the end of the surface material 312 is fixed to the folded portion 313*a* of the support member 313 by a fixing plate 313*b*. This is in order to keep the surface material 312 from peeling off from the support member 313 when the porous portion 311 is deformed by an approaching sheet-like article P. By fixing the end of the surface material 312 to the folded portion 313*a* of the support member 313, the porous portion 311 will only be subjected to a compressing force.

The side of the double take-out prevention block 31 from which the sheet-like articles approach is formed with a curvature radius R that is at least (maximum thickness of the sheet-like articles P−gap 33)×2, i.e. twice the difference between the maximum thickness of the sheet-like articles P and the gap 33. This means that the point where the sheet-like articles P come into contact with the double take-out prevention block 31 is at an angle of not greater than 45° from the suction holes 32. Thus, a gap through which the sheet-like article P passes is formed not only by the flexibility of the double take-out prevention block 31 but also through its compressive deformation, so that the suction holes 32 face the sheet-like article P.

The size La of the porous portion 311 is set to be at least five times the maximum deformation amount Lb (maximum thickness of the sheet-like articles P−gap 33). This is so as to reduce distortions in the compressive deformation of the porous portion 311 and to reduce the compressive deformation force. That is to say, the goal is to reduce the force with which the sheet-like article P deforms the double take-out prevention block 31, to reduce permanent compressive deformations of the porous portion 311, and moreover to increase the number of repetitions until the porous portion 311 undergoes fatigue failure due to repeated deformations.

The above-described double take-out prevention block 31 can be used as one set, in which two of such blocks are stacked and attached to each other one on top of the other, and the two suction holes 32 may be arranged along a line that is at a right angle with respect to the conveying direction of the sheet-like articles P.

If there is only one double take-out prevention block 31, then the sheet-like articles P may be stopped at one point, which may become a cause for skew, but if the sheet-like articles P are stopped at two points, skew can be suppressed.

Figure 4:
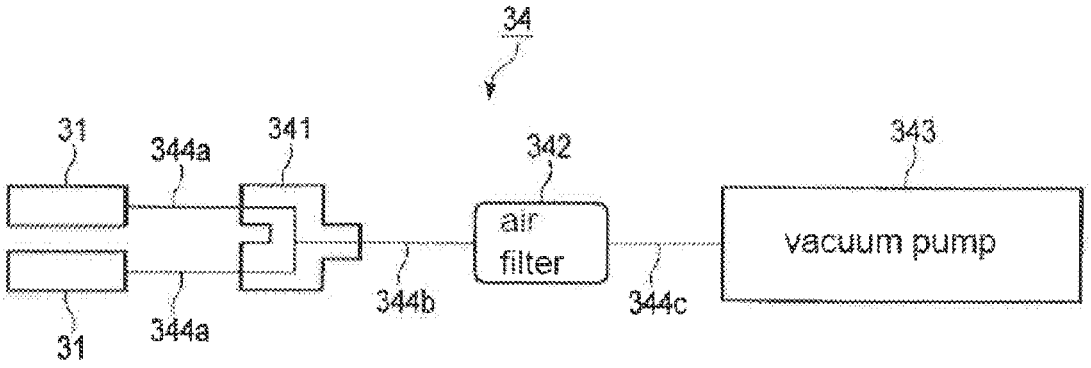
FIG. 4 is a block diagram illustrating the air drawing system that is connected to the double take-out prevention block of FIG. 2.

On the other hand, the suction holes 32 of the porous member 311 of the double take-out prevention blocks 31 are connected to an air system 34, as shown in FIG. 4, and air is pulled in from the suction holes 32.

That is to say, two pipes 344*a* of the air system 34 are connected to the two double take-out prevention blocks 31, and the two pipes 344*a* are joined together into one pipe at a joint 341. Moreover, the joint 341 is connected by one pipe 344*b*, an air filter 342 and a further pipe 344*c* to a vacuum pump 343. By generating negative pressure, the vacuum pump 343 draws in air from the suction holes 32 of the double take-out prevention blocks 31, thus suctioning the sheet-like articles 1.

The following is an explanation of the operation of taking out sheet-like articles P.

Figure 5:
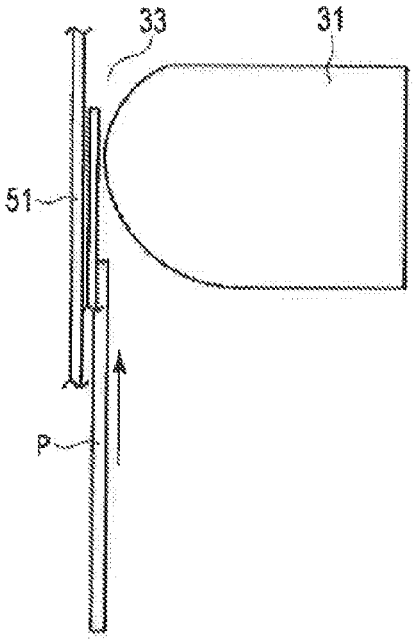
FIG. 5 is a diagram illustrating the state when a thin sheet-like article passes the gap between the conveying belt of FIG. 1 and the double take-out prevention block.

As shown in FIG. 1, the sheet-like articles P that are placed in an upright orientation on the supply belt 22 of the supply portion 2 are supplied towards the take-out portion 1 by moving the supply belt 22 and the backup paddle 21. The front-most sheet-like article P facing the take-out portion 1 is drawn by the sub-chamber 13 towards the take-out portion 1. This sheet-like article P is suctioned by the take-out belt 11 by the suction force of the air chamber 12, and is also suctioned by the assist roller 14. The suctioned sheet-like article P is taken out by rotating the take-out belt 11 and the assist roller 14. The sheet-like article P that has been taken out is then introduced into the gap 33 between the conveying belt 51 and the double take-out prevention block 31. At this time, if the relationship between the thickness of the sheet-like article P and the gap 33 is "thickness of sheet-like article P≤gap 33", that is, if the sheet-like article P is thinner than the gap 33, then the sheet-like article P passes the gap 33 without deforming the double take-out prevention block 31, as shown in FIG. 5.

Figure 6:
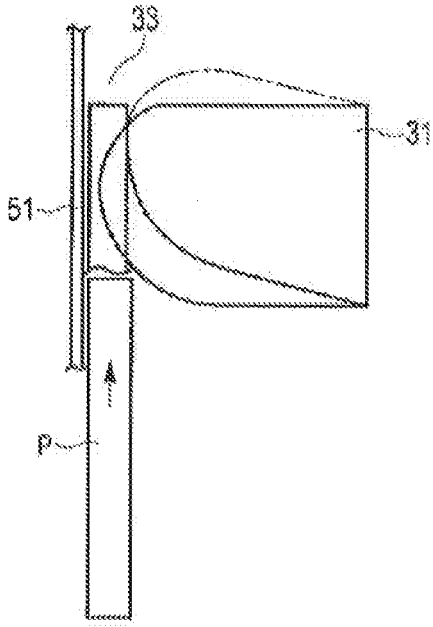
FIG. 6 is a diagram illustrating the state when a thick sheet-like article passes the gap between the conveying belt of FIG. 1 and the double take-out prevention block.

And if the relationship between the thickness of the sheet-like article P and the gap 33 is "thickness of sheet-like article P>gap 33", that is, if the sheet-like article P is thicker than the gap 33, then the sheet-like article P abuts against the double take-out prevention block 31, as shown in FIG. 6, elastically deforming it, so that the gap 33 is widened and the sheet-like article P passes (thickness of sheet-like article=gap 33+deformation amount of double take-out prevention block).

Thus, since in the present embodiment, the double take-out prevention block 31 is made of a porous material, the double take-out prevention block 31 can be elastically deformed in accordance with the thickness of the sheet-like article P that has been taken out. Consequently, when two sheet-like articles P overlapping each other are taken out together, if the their thickness is greater than the gap 33 between the conveying belt 51 and the double take-out prevention block 31, they can be passed along by elastically deforming the double take-out prevention block 31, and the sheet-like articles P can be separated.

Moreover, since the double take-out prevention block 31 is made of a porous material, it can be quickly restored from the elastic deformation after the sheet-like articles have passed, so that also the following sheet-like articles can be reliably separated.

Furthermore, the double take-out prevention block 31 is provided with suction holes 32, so that the sheet-like articles P can be separated even more reliably by suctioning the sheet-like articles P.

Moreover, the surface of the porous portion 311 of the double take-out prevention block 31 is provided with a surface material 312 having abrasion resistance, so that abrasion due to contact with the sheet-like article P can be prevented.

Figure 7:
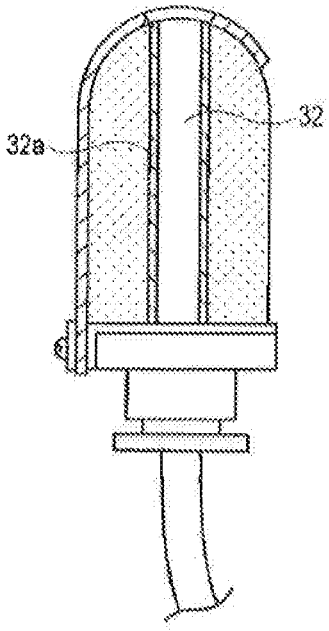
FIG. 7 shows another embodiment of the double take-out prevention block.

FIG. 7 shows a modification of the double take-out prevention block 31.

Elements that the same as those in the above-described embodiment are given the same reference numerals and are not explained any further.

Since the double take-out prevention block 31 is formed from a porous material having interconnected cells, when air is drawn in from the suction holes 32, there is the risk that the air is drawn in from the interconnected cells of the porous material and the ability to draw air from the suction holes 32 decreases.

To address this, in the arrangement in FIG. 7, for example a soft plastic pipe 32*a* is inserted into each of the suction holes 32, and air is drawn in through this pipe 32*a*.

With this example, it can be prevented that air is drawn in from the interconnected cells of the porous material, and there is the advantage that a favorable ability to draw air from the suction holes 32 can be maintained.

It should be noted that even though several embodiments of the disclosure have been explained, these embodiments are merely exemplary and are not meant to limit the scope of the disclosure. These new embodiments can be embodied in various forms, and various eliminations, replacements and other changes are possible, without departing from the disclosure. Also these other embodiments and modifications are to be included within the scope of the disclosure, and are included within the scope stated in the claims and equivalents thereof.

What is claimed is:

1. A sheet-handling apparatus, comprising:

a feeding portion to feed the sheet-like articles; and a separation portion facing the feeding portion, the separation portion being adapted to separate sheet-like articles in an overlapping state into individual sheet-like articles by elastically deforming depending on a thickness of the sheet-like articles, wherein a surface of the separation portion that faces the feeding portion is provided with a suction hole.

2. The sheet-handling apparatus according to claim 1, wherein the separation portion is made of a porous material.

3. The sheet-handling apparatus according to claim 1, wherein the surface of the separation portion that faces the feeding portion is a circularly arc-shaped surface.

4. The sheet-handling apparatus according to claim 3, wherein the side of the separation portion from which the sheet-like articles approach is provided with a curvature radius of at least (maximum thickness of the sheet-like articles−gap)×2.

5. The sheet-handling apparatus according to claim 1, wherein a surface material having abrasion resistance is provided along a surface of the separation portion that faces the feeding portion and a peripheral surface that is continuous with that surface of the separation portion facing the feeding portion.

6. The sheet-handling apparatus according to claim 5, further comprising:

a take-out portion to take out sheet-like articles to the feeding portion;

a gap between the separation portion and the feeding portion, wherein the gap varies in size depending on the elastic deformity; and a supporting portion that is adhered to the side of the separation portion that faces away from the feeding portion, wherein an end of the surface material is fixed to the supporting portion.

7. The sheet-handling apparatus according to claim 1 wherein a plurality of the separation portions are provided stacked on top of one another, such that a line on which the suction holes are arranged is perpendicular to a direction in which the sheet-like articles are taken out.

8. A sheet-handling method comprising:

directing a stack of at least two sheet-like articles to a path;

passing a first sheet-like article located at the top of the stack through the path while holding the remainder of the stack in place with a deformable selection block; and applying a suction force to the bottom of the stack of sheet-like articles at the selection block.

9. The sheet-handling method of claim 8 further comprising:

after passing the first sheet-like article through the path, passing a second sheet-like article located at the top of the remainder of the stack through the path by an upward force applied by the deformable selection block.

10. The sheet handling method of claim 8, wherein the selection block is made of a porous material.

11. The sheet handling method of claim 8, wherein the suction force is provided at a surface of the selection block with a suction hole.

12. The sheet handling method of claim 8, wherein the surface of the selection block is a circularly arc-shaped surface.

13. The sheet handling method of claim 8, wherein the side of the selection block from which the sheet-like articles approach is provided with a curvature radius of at least (maximum thickness of the sheet-like articles−gap)×2.

14. The sheet handling method of claim 8, wherein a surface material having abrasion resistance is provided along a surface of the separation portion that faces the feeding portion and a peripheral surface that is continuous with that surface of the separation portion facing the feeding portion.

15. A sheet-handling apparatus, comprising:

a take-out portion to take out sheet-like articles;

a feeding portion to feed the sheet-like articles that have been taken out by the take-out portion; and a separation portion facing the feeding portion across a gap, the separation portion comprising a suction hole wherein the sheet-like articles are suctioned by the suction hole such that sheet-like articles that have been taken out by the take-out portion in an overlapping state are separated into individual sheet-like articles, wherein the separation portion is adapted to elastically deform depending on a thickness of the sheet-like articles and vary the size of the gap.

16. The sheet-handling apparatus according to claim 15, wherein the separation portion is made of a porous material.

17. The sheet-handling apparatus according to claim 15, wherein the surface of the separation portion that faces the feeding portion is a circularly arc-shaped surface.

* * * * *